US006260307B1

(12) United States Patent
Richardson

(10) Patent No.: US 6,260,307 B1
(45) Date of Patent: Jul. 17, 2001

(54) ROOF CONSTRUCTION

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/506,132

(22) Filed: Feb. 17, 2000

(30) Foreign Application Priority Data

Mar. 18, 1999 (GB) ..... 9906085

(51) Int. Cl.[7] ..... E04F 13/00
(52) U.S. Cl. ..... 52/11; 52/92.2; 52/93.1
(58) Field of Search ..... 52/92.2, 93.2, 52/94, DIG. 17, 650.1, 655.1, 90.1, 93.1, 204.57, 731.1, 731.7; 411/84, 164, 107

(56) References Cited

U.S. PATENT DOCUMENTS

| | | | | |
|---|---|---|---|---|
| 4,015,388 | | 4/1977 | Hemminger . | |
| 4,750,310 | | 6/1988 | Holcombe . | |
| 5,144,776 | | 9/1992 | Hetzel et al. . | |
| 5,209,031 | * | 5/1993 | Tavano | 52/92.2 |
| 5,797,225 | * | 8/1998 | Ishikawa | 52/93.1 |
| 6,000,176 | | 12/1999 | Lancaster . | |
| 6,026,615 | * | 2/2000 | Richardson | 52/92.2 |

FOREIGN PATENT DOCUMENTS

| | | |
|---|---|---|
| 93 03883U | 7/1993 | (DE) . |
| 370988 | 5/1990 | (EP) . |
| 526785 | 2/1993 | (EP) . |
| 559292 | 9/1993 | (EP) . |
| 2165878 | 4/1986 | (GB) . |
| 2236791 | 1/1991 | (GB) . |
| 2257726 | 1/1993 | (GB) . |

* cited by examiner

*Primary Examiner*—Carl D. Friedman
*Assistant Examiner*—Steve Varner
(74) *Attorney, Agent, or Firm*—Rockey, Milnamow & Katz, Ltd.

(57) ABSTRACT

A conservatory roof comprises an eaves beam, glazing bars mounted at one end on the eaves beam and supporting glazing panels therebetween, and an insulator strip between the eaves beam head and the glazing bars to provide a thermal break.

21 Claims, 3 Drawing Sheets

ROOF CONSTRUCTION

BACKGROUND OF THE INVENTION

This invention concerns roof construction and, in particular concerns glazed roof construction, such as for forming a conservatory.

Conservatory roofs are generally formed from glazing panels supported at their edges by glazing bars fixed between a ridge beam and an eaves beam. The glazing bars and eaves beams are usually made of aluminium and their contact is a source of cold spot formation that can lead to condensation formation within the conservatory, which is undesirable.

An object of this invention is to improve thermal properties for a conservatory roof.

SUMMARY OF THE INVENTION

According to this invention is proposed a thermal break be interposed between glazing bars and an eaves beam in forming a conservatory roof.

The preferred eaves beam for use in the invention is generally L-shaped having an upstand and a base plate. The upstand may be double walled. The upstand preferably has an enlarged head. The eaves beam preferably has at least one location for attachment of internal cladding and at least one location for attachment of guttering or of brackets for supporting, uttering. The base plate in use sits on a supporting structure, such as a wall or window frames.

The thermal break is preferably in the form of an insulator strip of plastics material that lies on the eaves beam. The insulator strip is preferably a snap fit onto a head of the eaves beam. For example, the eaves beam head may have lips on opposite sides over which resiliently deformable sides of the strip can snap fit.

The head of the eaves beam preferably has two alternative areas on which glazing bars can rest depending on the roof pitch. The insulator strip matches those areas in profile but it is preferred that those areas of the insulator strip have ribs or the like on its underside to space the strip from the eaves beam to improve insulation properties.

The head of the eaves beam preferably has a depression therein to receive and guide fixing screws for securing the glazing bars to the eaves beam. That depression preferably has a roughened, say serrated surface, to provide grip for the screw point as it is being screwed through a glazing bar into the eaves beam.

The insulator strip preferably also has on its intended outer end, i.e. relative to the conservatory, a deformable web for bridging any gap between the eaves beam and the overlying glazing bars or panels.

The insulator strip also preferably provides a location for attachment of the internal cladding to cover the eaves beam. The insulator strip may have a downwardly open slot to receive a top edge of a cladding piece. The eaves beam may have a rib, such as of the so-called fir-tree type that fits into a channel or slot formed on the intended hidden face of the cladding.

The base plate of the eaves beam may also have a sealing strip applied thereto, the sealing strip having a deformable web that bridges between the base plate and the underside of guttering attached to the eaves beam. The sealing strip may also have a downstand to hide the junction between the base plate of the eaves beam and the supporting structure.

BRIEF DESCRIPTION OF THE DRAWINGS

This invention will now be further described, by way of example only, with reference to the accompanying drawings, in which.

Figure 1:
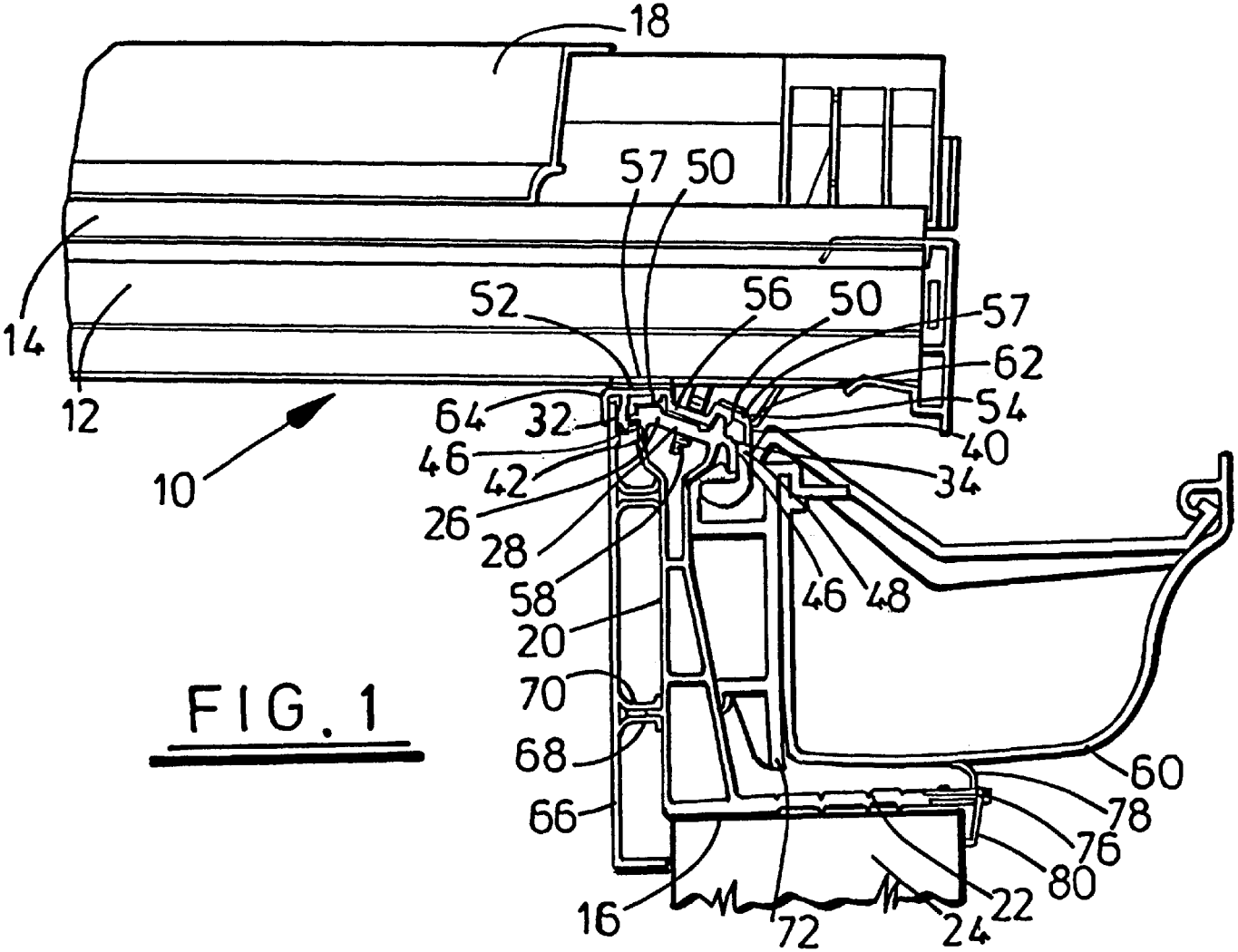
FIG. 1 is a section through a low pitch conservatory roof at its eaves.
Figure 1A:
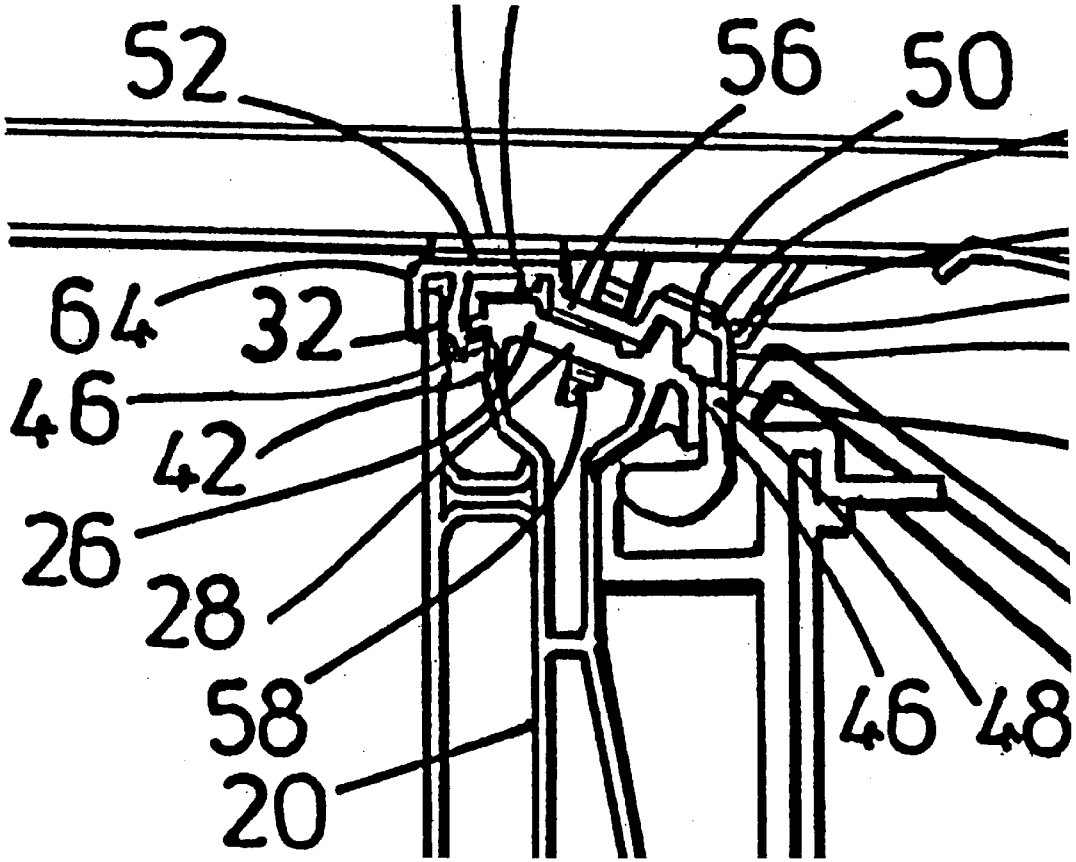
FIG. 1A is an enlarged detail taken from FIG. 1.

Via a separate paper, applicant is requesting approval of an added view, FIG. 1A, which is an enlarged detail taken from FIG. 1. Applicant submits that the enlarged detail clarified structures at the head of the eaves beam.

DETAILED DESCRIPTION OF THE INVENTION

Referring to FIG. 1 of the accompanying drawings, a conservatory roof 10 comprises glazing panels 12 supported between glazing bars 14, the glazing bars being secured at their top ends to a ridge beam (not shown) and at bottom ends to an eaves beam 16. The glazing, bars, ridge beam and eaves beam are all made from aluminium.

The glazing bars 14 are of inverted T-section having a cross bar and an upstand. The glazing panels sit on the cross bar and are held down by top cappings 18 that are clip fits onto the glazing bars.

The eaves beam 16 is generally L-shaped having a double walled upstand 20 and a single walled base plate 22. The base plate 22 sits on and is secured to the underlying support structure, such as provided by window frames 24. The upstand has 20 an enlarged head 26 with a generally arcuate top surface but with a depression 28 therein. The base of the depression has a serrated or roughened surface. Either side of the depression, the head of the eaves beam has two alternative inner and outer areas 32 and 34 respectively on which glazing bars can rest depending on the pitch of the roof. In this embodiment the roof illustrated has a low pitch and so the eaves beam 16 rests on the inner area 32.

Interposed between the glazing bars and the eaves beam and lying on the eaves beam is a thermal insulator strip 40 of plastics material. The insulator strip 40 snap fits onto the head 26 of the eaves beam. On opposite sides of the head of the eaves beam are ribs 42, 44 over which lips 46, 48 of the insulator can snap.

The insulator strip is formed as an extrusion and has a profile generally following the contours of the head of the eaves beam. The insulator strip is provided with ribs 50 on its underside to space inner and outer parts 52, 54 thereof from the inner and outer areas 32, 34 of the eaves beam head, whilst a central part 56 of the insulator strip sits in the depression in the head of the eaves beam. The inner and outer parts 52, 54 of the insulator strip are provided on their top surfaces with double-sided adhesive tape 57 in order to hold the glazing bars 14 in place whilst they are being secured with screws 58 to the eaves beam.

Extending forwardly of the insulator strip i.e. towards gutter 60 on the outside of the conservatory is a thin resiliently flexible web 62. The web 62 contacts the underside of the glazing bar 14 or any bottom capping thereon or the underside of the glazing panels 12 to provide a wind break.

On its inner end i.e. the end towards the inside of the conservatory, the insulator strip has a lip 64 extending outwardly and then downwardly to form a slot which serves as a top location for internal plastics cladding 66 for the eaves beam 16. The eaves beam has lower down a fir-tree connector 68 along its length onto which a slot 70 of the cladding is a push-fit.

The eaves beam 16 supports brackets 72 for the gutter 60 and the leading edge of the base plate 22 of the eaves beam has a push-fit trim 76 thereon, which has a flexible resilient web 78 upstanding to seal between the underside of the gutter and the eaves beam. Furthermore, the trim has a downstand 80 to cover profile features.

The insulator strip provides a thermal break between the glazing bars and the eaves beam, which otherwise, both being of aluminium, would provide a route for heat loss leading to condensation formation within the conservatory on the eaves beam.

Figure 2:
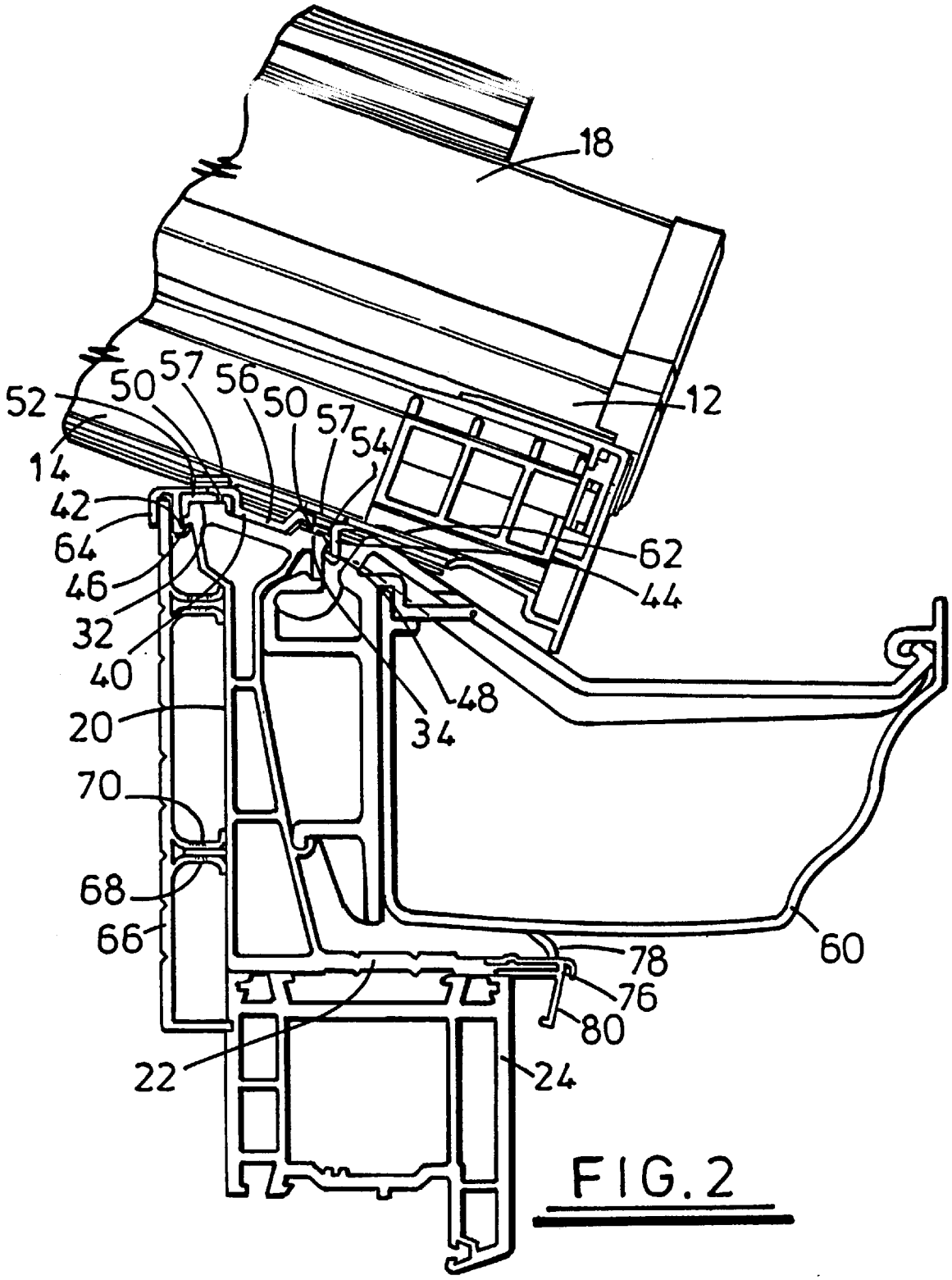
FIG. 2 is a section through a higher pitch conservatory roof at its eaves.

Turning to FIG. 2 of the drawings, a similar arrangement is shown but with a pitched roof of greater slope. The components are the same as in FIG. 1 and have been given the same reference numerals. In this arrangement the glazing bars rest on the outer area 34 of the insulator rather than the inner area 32 and the web 62 of the insulator strip is deformed more because of the slope of the roof.

What is claimed is:

1. A conservatory roof comprising an eaves beam, glazing bars mounted at one end on the eaves beam and supporting glazing panels therebetween, and a thermal break between glazing bars and the eaves beam.

2. A conservatory roof as claimed in claim 1, wherein the eaves beam is generally L-shaped having a base plate and an upstand.

3. A conservatory roof as claimed in claim 2, wherein the eaves beam upstand is double walled.

4. A conservatory roof as claimed in claim 1, wherein the eaves beam has an enlarged head.

5. A conservatory roof as claimed in claim 1, wherein the eaves beam has at least one location for attachment of internal cladding.

6. A conservatory roof as claimed in claim 1, wherein the eaves beam has at least one location for attachment of guttering or of brackets for supporting guttering.

7. A conservatory roof as claimed in claim 1, wherein the thermal break is an insulator strip of plastics material lying on the eaves beam.

8. A conservatory roof as claimed in claim 7, wherein the insulator strip is a snap-fit onto a head of the eaves beam.

9. A conservatory roof as claimed in claim 8, wherein the eaves beam head has lips on opposite sides over which resiliently deformable sides of the insulation strip snap-fit.

10. A conservatory roof as claimed in claim 1, wherein the eaves beam has a head having two alternative areas on which glazing bars are supported depending upon the roof pitch.

11. A conservatory roof as claimed in claim 10, wherein the insulator strip matches said areas of the eaves beam head in profile.

12. A conservatory roof as claimed in claim 11, wherein said area of the insulator strip have ribs or the like on its underside to space the strip from the eaves beam.

13. A conservatory roof as claimed in claim 1, wherein the eaves beam has a head with a depression therein to receive and guide fixing screws for the glazing bars.

14. A conservatory roof as claimed in claim 13, wherein the depression of the eaves beam head has a roughened surface.

15. A conservatory roof as claimed in claim 14, wherein the depression has a serrated surface.

16. A conservatory roof as claimed in claim 7, wherein the insulator strip has on its outer end relative to the conservatory a deformable web for bridging any gap between the eaves beam and the overlying glazing bars or panels.

17. A conservatory roof as claimed in claim 7, wherein the insulator strip has a location for attachment of internal cladding to the eaves beam.

18. A conservatory roof as claimed in claim 17, wherein the insulator strip has a downwardly open slot for receiving a top edge of a cladding piece.

19. A conservatory roof as claimed in claim 5, wherein the eaves beam has a rib that fits into a channel or slot of the intended hidden face of the cladding.

20. A conservatory roof as claimed in claim 2, wherein the eaves beam base plate has a sealing strip applied thereto, the sealing strip having a deformable web that bridges between the base plate and the underside of guttering attached to the eaves beam.

21. A conservatory roof as claimed in claim 20, wherein the sealing strip has a downstand to hide the junction between the base plate of the eaves beam and a supporting structure.

* * * * *